US012221241B2

(12) United States Patent
Liu et al.

(10) Patent No.: US 12,221,241 B2
(45) Date of Patent: Feb. 11, 2025

(54) PACKAGING BOX HOISTING DEVICE

(71) Applicant: SHANDONG REEBOW INTELLIGENT EQUIPMENT CO., LTD., Zibo (CN)

(72) Inventors: Yueyong Liu, Zibo (CN); Huabing Zhang, Zibo (CN); Yixue He, Zibo (CN); Junhua Zhou, Zibo (CN); Guanhua Wang, Zibo (CN); Zhihan Wang, Zibo (CN)

(73) Assignee: SHANDONG REEBOW INTELLIGENT EQUIPMENT CO., LTD., Zibo (CN)

( * ) Notice: Subject to any disclaimer, the term of this patent is extended or adjusted under 35 U.S.C. 154(b) by 0 days.

(21) Appl. No.: 18/711,924

(22) PCT Filed: Jul. 28, 2023

(86) PCT No.: PCT/CN2023/109705
§ 371 (c)(1),
(2) Date: May 21, 2024

(87) PCT Pub. No.: WO2024/022463
PCT Pub. Date: Feb. 1, 2024

(65) Prior Publication Data

US 2024/0417122 A1 Dec. 19, 2024

(30) Foreign Application Priority Data

Jul. 29, 2022 (CN) ..... 202221973049.1
Mar. 20, 2023 (CN) ..... 202320535772.X

(51) Int. Cl.
*B65B 43/58* (2006.01)
*B65B 43/42* (2006.01)
(Continued)

(52) U.S. Cl.
CPC ..... *B65B 43/46* (2013.01)

(58) Field of Classification Search
CPC ..... B65B 43/42; B65B 43/46; B65B 43/54; B65B 43/56; B65B 43/58
(Continued)

(56) References Cited

U.S. PATENT DOCUMENTS 4,224,781 A * 9/1980 Salenbo ..... B65B 43/54 53/473
5,330,317 A * 7/1994 Akimoto ..... B65B 43/44 414/796.4
(Continued)

FOREIGN PATENT DOCUMENTS

CN 208747166 U 4/2019
CN 210028110 U 2/2020
(Continued)

*Primary Examiner* — Douglas A Hess
(74) *Attorney, Agent, or Firm* — Bayramoglu Law Offices LLC

(57) ABSTRACT

A packaging box hoisting device includes a fixing arm arranged vertically. A lifting mechanism for driving the lifting of the fixing arm is arranged at a side of the fixing arm. Multiple operation stations are arranged in the fixing arm from top to bottom. A driving device for driving the operation station to move and fixing or releasing a packaging box in the operation station is arranged at an end of the operation station. A braking mechanism for keeping the packaging box in the operation station stationary at least when the driving device drives to release the packaging box in the operation station is also arranged at the side of the fixing arm. The packaging box hoisting device contributes to the completion of various processes for product packaging in the vertical direction.

11 Claims, 6 Drawing Sheets

(51) Int. Cl.
*B65B 43/46* (2006.01)
*B65B 43/54* (2006.01)
*B65B 43/56* (2006.01)

(58) Field of Classification Search
USPC ..... 269/86
See application file for complete search history.

(56) References Cited

U.S. PATENT DOCUMENTS

| | | | | | |
|---|---|---|---|---|---|
| 5,785,804 | A * | 7/1998 | Kovacs | B65B 43/465 | 156/216 |
| 5,983,601 | A * | 11/1999 | Blanch | B65B 7/2842 | 53/118 |
| 6,776,197 | B1 * | 8/2004 | DeCrane | B65B 43/54 | 141/10 |
| 9,126,705 | B2 * | 9/2015 | Ours | B65B 43/62 | |
| 11,396,433 | B1 * | 7/2022 | Euculano | B65G 69/08 | |

FOREIGN PATENT DOCUMENTS

| | | | |
|---|---|---|---|
| CN | 216916528 | U | 7/2022 |
| CN | 114955093 | A | 8/2022 |
| WO | 2021019193 | A1 | 2/2021 |

* cited by examiner

PACKAGING BOX HOISTING DEVICE

CROSS REFERENCE TO THE RELATED APPLICATIONS

This application is the national phase entry of International Application No. PCT/CN2023/109705, filed on Jul. 28, 2023, which is based upon and claims priority to Chinese Patent Applications No. 202221973049.1, filed on Jul. 29, 2022, and No. 202320535772.X, filed on Mar. 20, 2023, the entire contents of which are incorporated herein by reference.

TECHNICAL FIELD

A packaging box hoisting device belongs to the technical field of product packaging.

BACKGROUND

At present, in many fields (such as gloves), products need to be packaged in packaging boxes. In the process of packaging products, multiple processes need to be completed in turn: putting products into packaging boxes and sealing end covers on both sides of packaging boxes respectively. In the prior art, an assembly line for product packaging is generally arranged horizontally. That is, various processes for product packaging are provided in turn in a horizontal direction. However, the packaging mode will occupy a lot of space. In the prior art, aiming at the drawbacks of the scheme of horizontal packaging, a scheme of vertical packaging is proposed. That is, various processes for product packaging are provided in turn in a vertical direction. Therefore, aiming at the scheme of vertical packaging, a technical solution which can realize the sequential hoisting of packaging boxes in the vertical direction to complete each packaging process is designed, which becomes an urgent problem to be solved in the art.

SUMMARY

Technical Solution

In view of technical problems to be solved by the present disclosure, a packaging box hoisting device capable of synchronously transferring all packaging boxes in a vertical direction by a fixing arm, a braking mechanism, and a lifting mechanism so as to contribute to the completion of various processes for product packaging in the vertical direction is provided to overcome the deficiency of the prior art.

The technical solution adopted by the present disclosure for solving the technical problems is as follows. The packaging box hoisting device includes a fixing arm arranged vertically. A lifting mechanism for driving the lifting of the fixing arm is arranged at a side of the fixing arm. Multiple operation stations are arranged in the fixing arm from top to bottom or from bottom to top. A driving device for driving the operation station to move and fixing or releasing a packaging box in the operation station is arranged at an end of the operation station.

Preferably, a translation mechanism for driving the fixing arm to move horizontally and reciprocally is arranged on an outer side of the lifting mechanism. The lifting mechanism is connected to the translation mechanism.

Preferably, the fixing arm includes at least one clamping arm. The clamping arm includes an inner clamping plate and an outer clamping plate. Clamp plates fixed to ends of the inner clamping plate and the outer clamping plate from the operation station. The driving device is configured to drive the inner clamping plate and the outer clamping plate to move relatively.

Preferably, the lifting mechanism includes a lifting fixing plate. The lifting fixing plate is connected to the translation mechanism. A lifting motor is fixed to a surface of the lifting fixing plate. A lifting screw is coaxially fixed to a motor shaft of the lifting motor. The lifting motor is threaded to the fixing arm through the lifting screw.

Preferably, two clamping arms are arranged. Outer frames are arranged on outer sides of the two clamping arms. Translation guide rails are arranged on inner side faces of the two outer frames. The two clamping arms are slidably connected to the corresponding outer frames through the translation guide rails on the outer sides thereof. The translation mechanism is arranged on the inner side face of the outer frame.

Preferably, the translation mechanism includes a translation motor. The outer frame is provided with a translation screw. The translation screw is connected to the motor shaft of the translation motor through a translation conveyor belt. The translation screw is threaded to a translation nut seat. The translation nut seat is fixed to the lifting mechanism.

Preferably, the lifting mechanism is fixed to the clamping arm. The clamp plates include upper clamp plates and lower clamp plates. Multiple upper clamp plates are arranged on an inner side face of each inner clamping plate from top to bottom. Multiple lower clamp plates are arranged on an inner side face of each outer clamping plate. The upper clamp plates and the lower clamp plates correspond to each other one by one vertically.

Preferably, the driving device is a clamping motor. A motor shaft of the clamping motor is coaxially fixed to a clamping screw. The clamping screw is reversely threaded to the inner clamping plate and the outer clamping plate.

Preferably, the upper clamp plate or the lower clamp plate is an elastic clamp plate in each operation station.

Preferably, a braking mechanism for keeping the packaging box in the operation station stationary at least when the driving device drives to release the packaging box in the operation station is also arranged at the side of the fixing arm.

Preferably, the braking mechanism includes two auxiliary fixing plates which are arranged oppositely. A braking device drives the two auxiliary fixing plates to move relatively. Multiple groups of auxiliary clamp plates are arranged on surfaces of the two auxiliary fixing plates. Each group of auxiliary clamp plates is correspondingly located at both sides of the operation station.

Preferably, an auxiliary adjusting device is also arranged in the operation station. The auxiliary adjusting device is fixed to the inner clamping plate, and the upper clamp plate in the corresponding operation station is fixed to a movable end of the auxiliary adjusting device. Or/and the auxiliary adjusting device is fixed to the outer clamping plate, and the lower clamp plate in the corresponding operation station is fixed to the movable end of the auxiliary adjusting device.

Preferably, the two outer frames are connected by a width adjusting mechanism.

Beneficial Effects

Compared with the prior art, the present disclosure has the beneficial effects as follows.

1. In the packaging box hoisting device, all packaging boxes can be synchronously transferred in a vertical direction by the fixing arm, the braking mechanism, and the lifting mechanism so as to contribute to the completion of various processes for product packaging in the vertical direction.

2. In the packaging box hoisting device, the translation mechanism cooperates with the lifting mechanism and the driving device to realize an action cycle of the fixing arm to the packaging box: clamping the packaging box, vertically ascending for one operation station, releasing the packaging box, translating backward to exit the operation station, vertically descending for one operation station, translating forward to arrive at the operation station, and clamping (a next) packaging box, thus realizing the sequential hoisting of the packaging box in the vertical direction.

3. The clamping arm is arranged in the fixing arm, and the packaging box is clamped by the clamping arm, which is convenient for a packaging mechanism in a packaging machine to carry out corresponding packaging operations on the packaging box.

4. With the elastic clamp plates, when clamping the packaging box, a floating plate makes an elastic contact with an upper surface (or lower surface) of the packaging box under the action of a spring, so as to avoid damage to the packaging box caused by a rigid contact.

5. By controlling an output distance of the auxiliary adjusting device, the height of a certain operation station can be adjusted separately.

6. The two outer frames are connected by the width adjusting mechanism, and the spacing between the two outer frames is adjusted by the width adjusting mechanism, thus realizing the adjustment of the spacing between the two clamping arms, so as to be suitable for packaging boxes with different widths.

In the figures: 1, inner clamping plate; 2, clamping screw; 3, upper clamp plate; 4, outer clamping plate; 5, clamping motor; 6, lower clamp plate; 7, translation guide rail; 8, outer frame; 9, translation mechanism; 10, lifting motor; 11, lifting nut seat; 12, lifting fixing plate; 13, lifting screw; 14, internal fixing member; 15, auxiliary adjusting cylinder; 16, clamping slide rail; 17, translation screw; 18, translation conveyor belt; 19, translation motor; 20, translation nut seat; 21, slide plate; 22, guide shaft; 23, linear bearing; 24, floating plate; 25, fixing plate; 26, width adjusting motor; 27, first fixing block; 28, width adjusting screw; 29, second fixing block; 30, auxiliary fixing plate; 31, braking fixing plate; 32, braking cylinder; 33, packaging box; 34, fixing arm; 35, lifting mechanism; and 36, operation station.

DETAILED DESCRIPTION OF THE EMBODIMENTS

FIG. 1 to FIG. 7 are preferred embodiments of the present disclosure. The present disclosure will be further explained in connection with FIG. 1 to FIG. 7.

Figure 1:
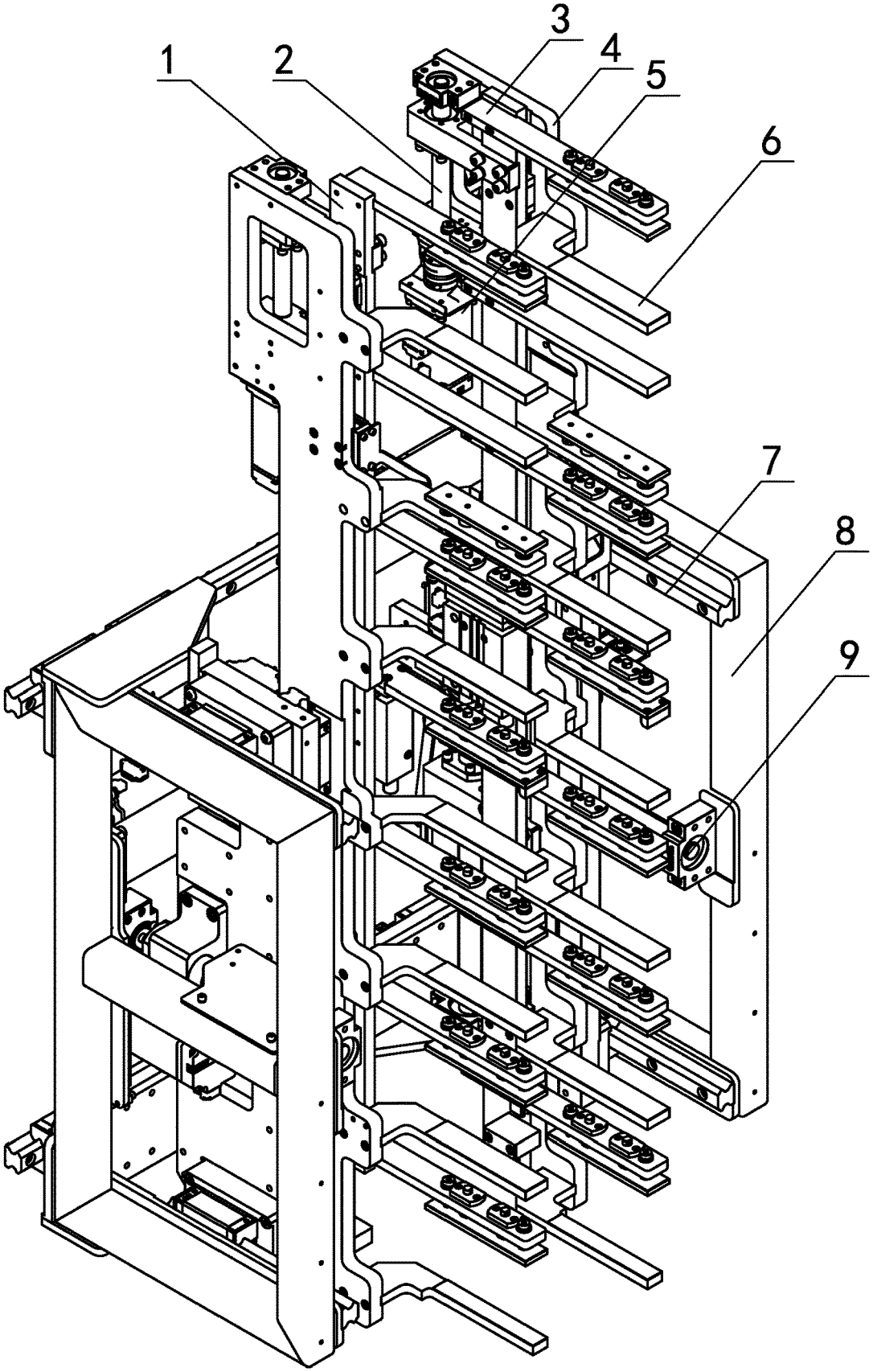
FIG. 1 is a forward axonometric view of a packaging box hoisting device.
Figure 2:
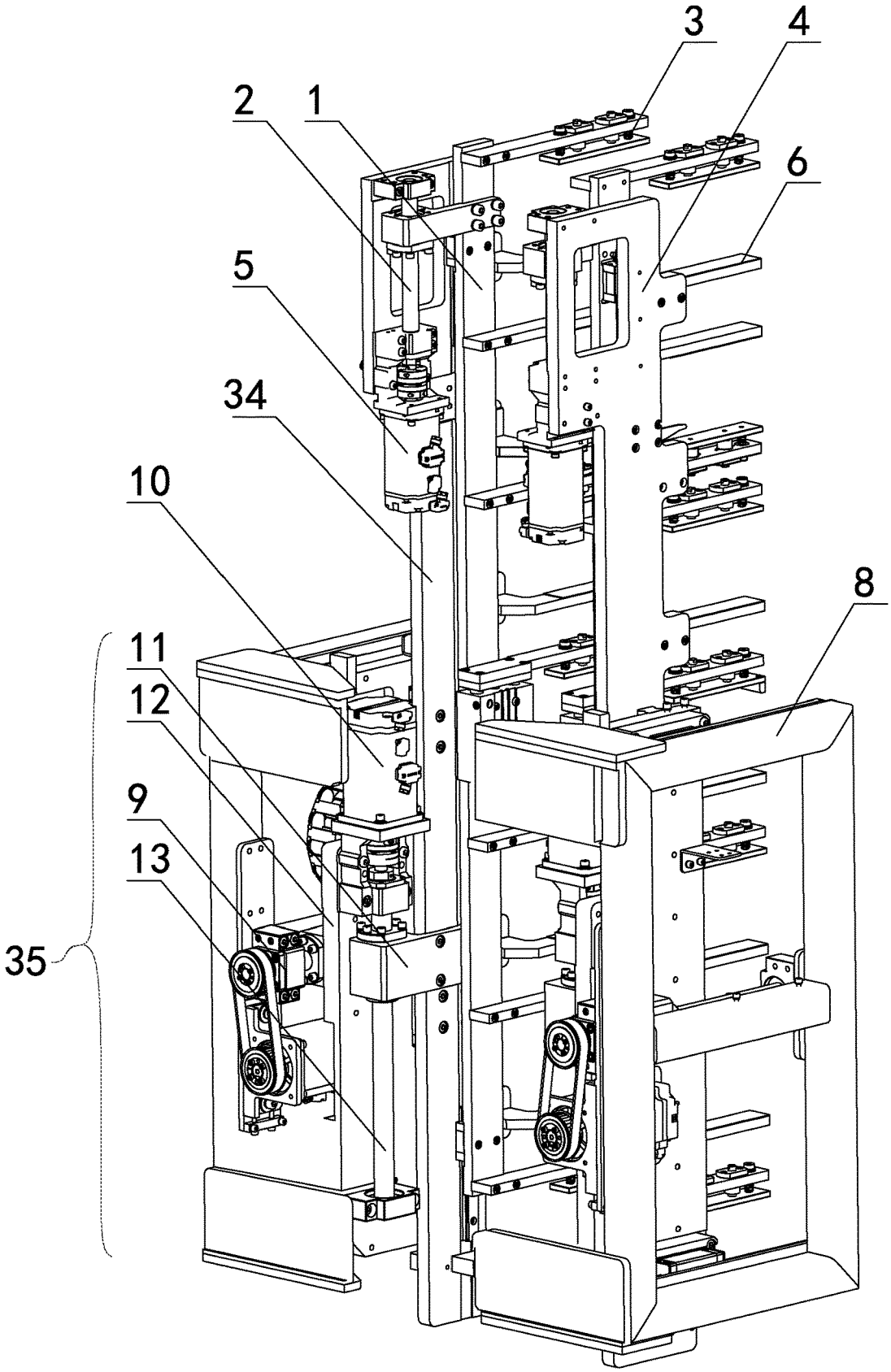
FIG. 2 is a backward axonometric view of a packaging box hoisting device.

As shown in FIG. 1 to FIG. 2, a packaging box hoisting device includes a fixing arm 34 arranged vertically. A lifting mechanism 35 for driving the lifting of the fixing arm is arranged at a side of the fixing arm. Multiple operation stations 36 are arranged in the fixing arm from top to bottom. A driving device for driving the operation station to move and fixing or releasing a packaging box 33 (referring to FIG. 7) in the operation station is arranged at an end of the operation station.

The fixing arm includes at least one clamping arm. The lifting mechanism is fixed to the clamping arm. In the packaging box hoisting device, two clamping arms are arranged side by side vertically and symmetrically. By arranging the two clamping arms, the two clamping arms clamp the packaging box 33 from both sides, thus ensuring the clamping effect of the packaging box 33 in the hoisting and packaging operation processes. Outer frames 8 are arranged on outer sides of the two clamping arms. Translation guide rails 7 are arranged on inner side faces of the two outer frames 8. The translation guide rails 7 are arranged horizontally on upper and lower parts of the outer frames 8. The two clamping arms are slidably connected to the corresponding outer frames 8 through the translation guide rails 7 on the outer sides thereof.

A translation mechanism 9 for driving the fixing arm to move horizontally and reciprocally is arranged on an outer side of the lifting mechanism. The lifting mechanism is connected to the translation mechanism 9. The translation mechanism 9 is located between the inner side faces of the two outer frames 8. The two clamping arms are fixed to the lifting mechanisms on the corresponding sides. By arranging the translation mechanism 9, the whole translation of the fixing arm is realized, and it is convenient to realize the sequential hoisting of the packaging box 33 in the vertical direction by the clamping arm.

The lifting mechanism includes a lifting fixing plate 12. The lifting fixing plate 12 is connected to the translation mechanism 9. A lifting motor 10 is fixed to a surface of the lifting fixing plate 12. A motor shaft of the lifting motor 10 is vertically downward. A lifting screw 13 is coaxially fixed to the motor shaft of the lifting motor 10. A lifting nut seat 11 is sleeved outside the lifting screw 13. The lifting nut seat 11 is threaded to the lifting screw 13, and the lifting nut seat 11 is also fixed to the corresponding clamping arm. The lifting motor 10 is threaded to the fixing arm through the lifting screw 13. The lifting mechanism realizes the whole lifting of the clamping arm.

Figure 4:
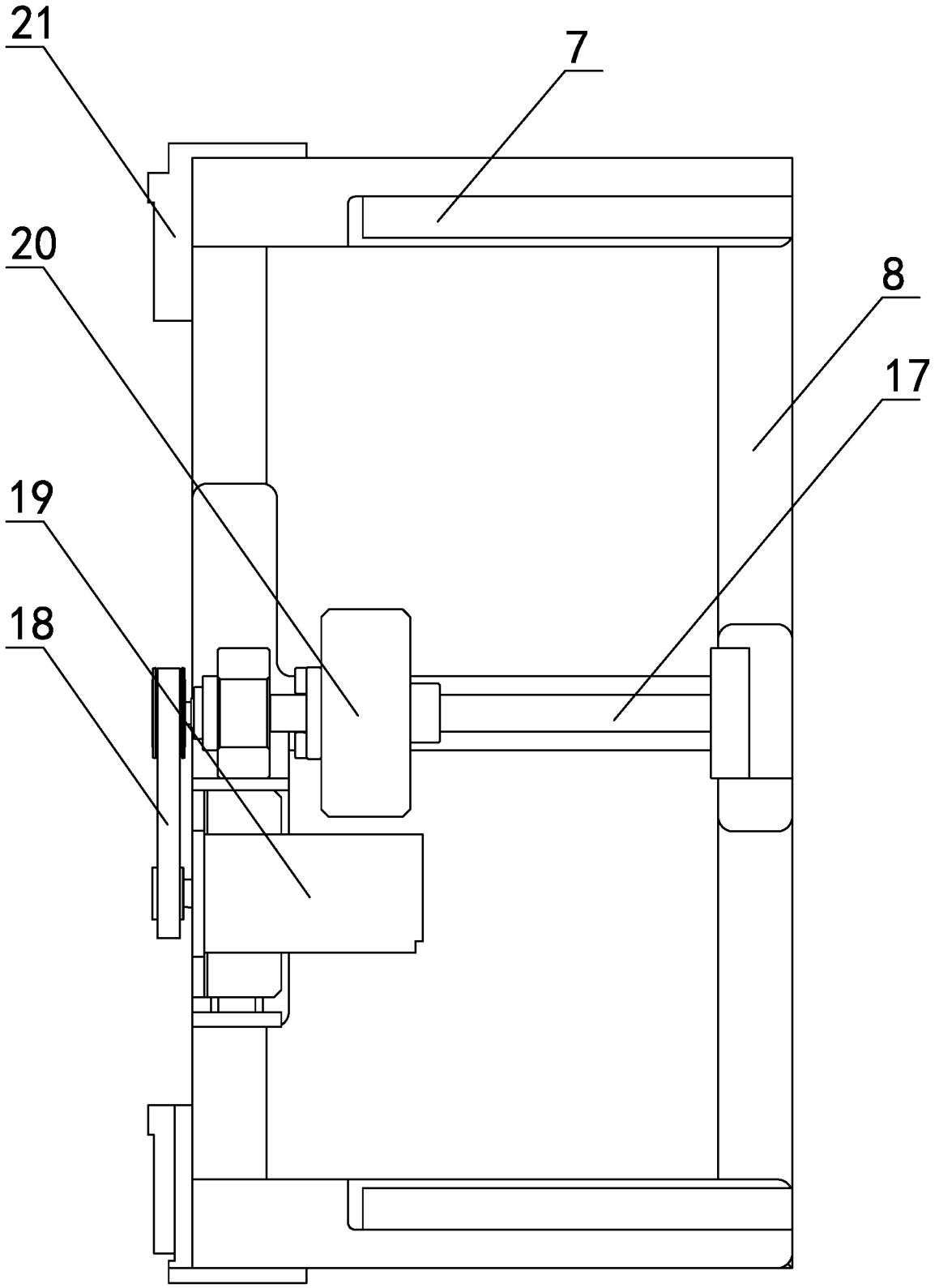
FIG. 4 is a front view of a translation mechanism of a clamping arm of a packaging box hoisting device.

Referring to FIG. 4, the translation mechanism 9 includes a translation motor 19. A motor shaft of the translation motor 19 horizontally faces back and protrudes from a rear edge of the outer frame 8. The outer frame 8 is provided with a translation screw 17. The translation screw 17 is horizontally fixed to the middle of the outer frame 8 through screw support seats on front and rear sides. After a rear end of the translation screw 17 extends to the rear edge of the outer frame 8, the translation screw 17 is connected to the motor shaft of the translation motor 19 through a translation conveyor belt 18. The translation screw 17 is threaded to a translation nut seat 20. The translation nut seat 20 is fixed to the lifting mechanism. Specifically, the translation nut seat 20 is fixed to an outer side face of the lifting fixing plate 12 in the lifting mechanism. When the translation motor 19 rotates, the translation conveyor belt 18 drives the translation screw 17 to rotate, and the lifting mechanism and the whole clamping arm are further driven to reciprocate along the front and back direction of the outer frame 8 by the translation nut seat 20.

Figure 6:
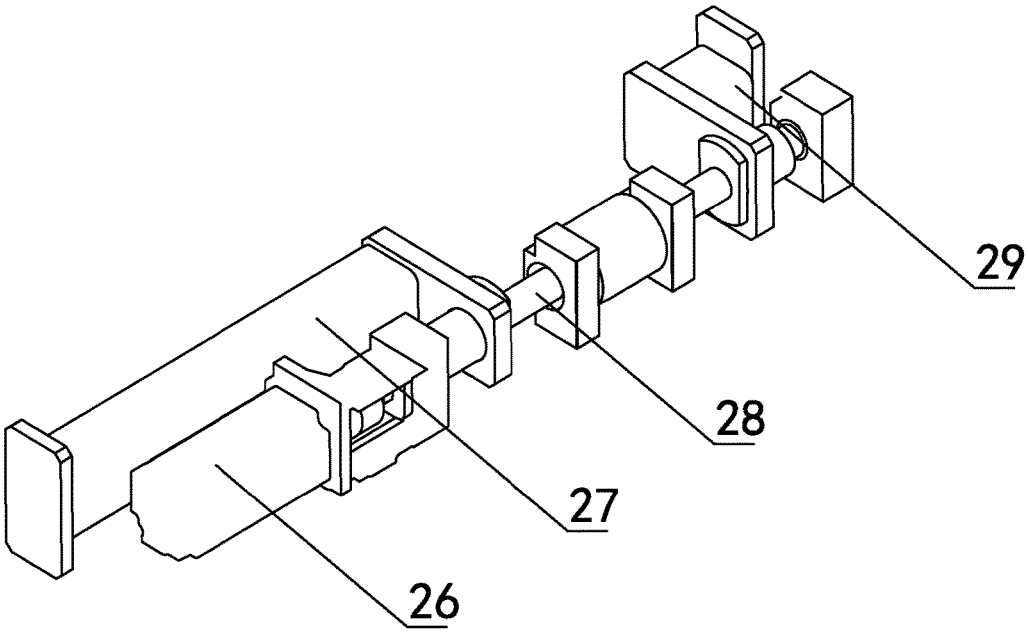
FIG. 6 is an axonometric view of a width adjusting mechanism of a packaging box hoisting device.
Figure 7:
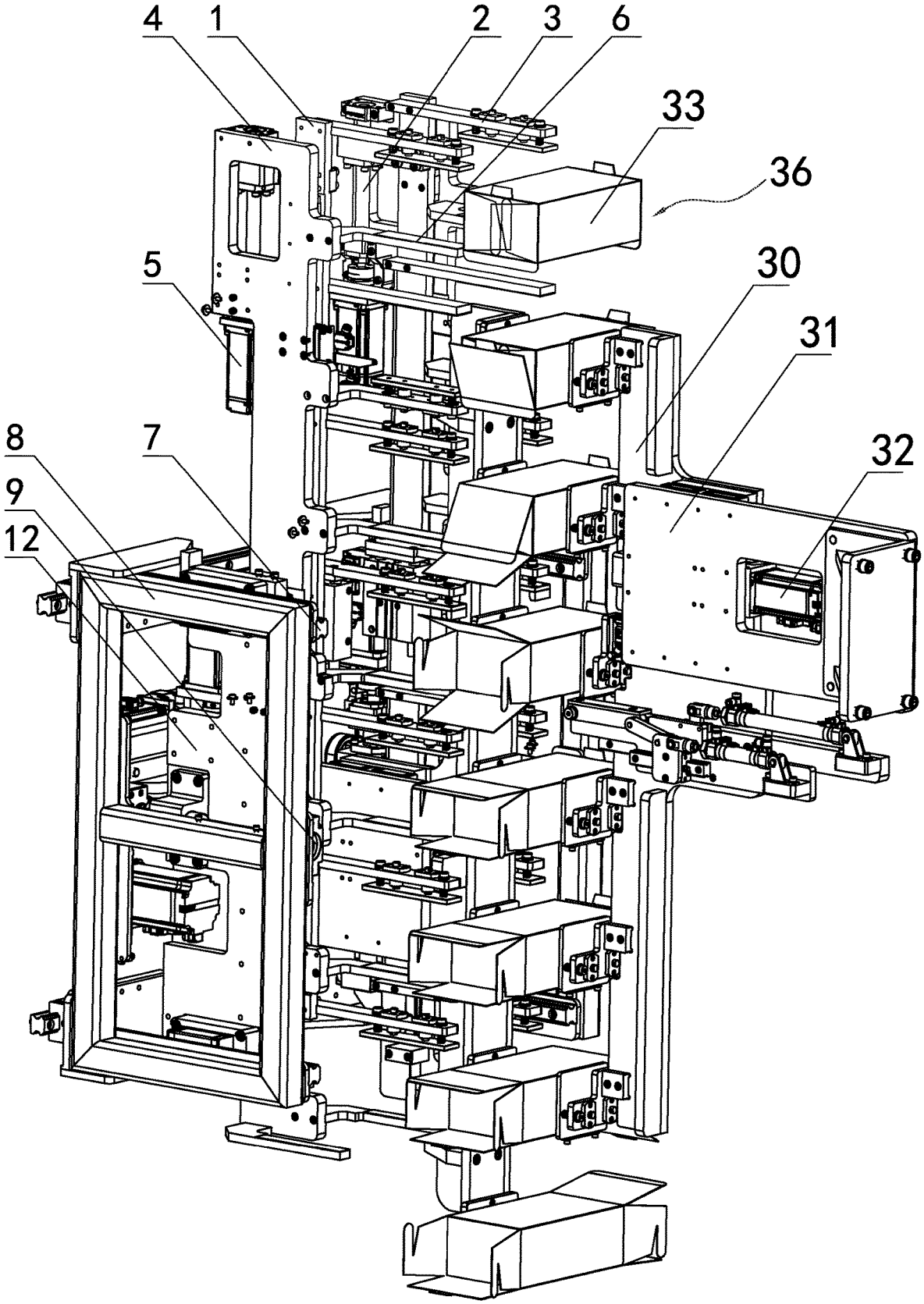
FIG. 7 is an axonometric view of a packaging box hoisting device added with a braking mechanism.

The two outer frames 8 are connected by a width adjusting mechanism, and the spacing between the two outer frames 8 is adjusted by the width adjusting mechanism, thus realizing the adjustment of the spacing between the two clamping arms, so as to be suitable for packaging boxes 33 with different widths (referring to FIG. 7). As shown in FIG. 6, the width adjusting mechanism includes a width adjusting motor 26 arranged horizontally. A width adjusting screw 28 is coaxially fixed to a motor shaft of the width adjusting motor 26. A first fixing block 27 and a second fixing block 29 are reversely threaded to the width adjusting screw 28. The first fixing block 27 and the second fixing block 29 are fixed to the two outer frames 8, respectively. Therefore, the spacing between the two outer frames 8 may be adjusted when the width adjusting motor 26 is operated.

Both upper and lower ends of rear ends of the two outer frames 8 are each provided with a slide plate 21. A rear surface of the slide plate 21 is provided with a slide groove. Slide rails are arranged in the upper and lower slide grooves to guide the outer frames 8 on both sides when the width of the outer frames 8 on both sides is adjusted.

Figure 3:
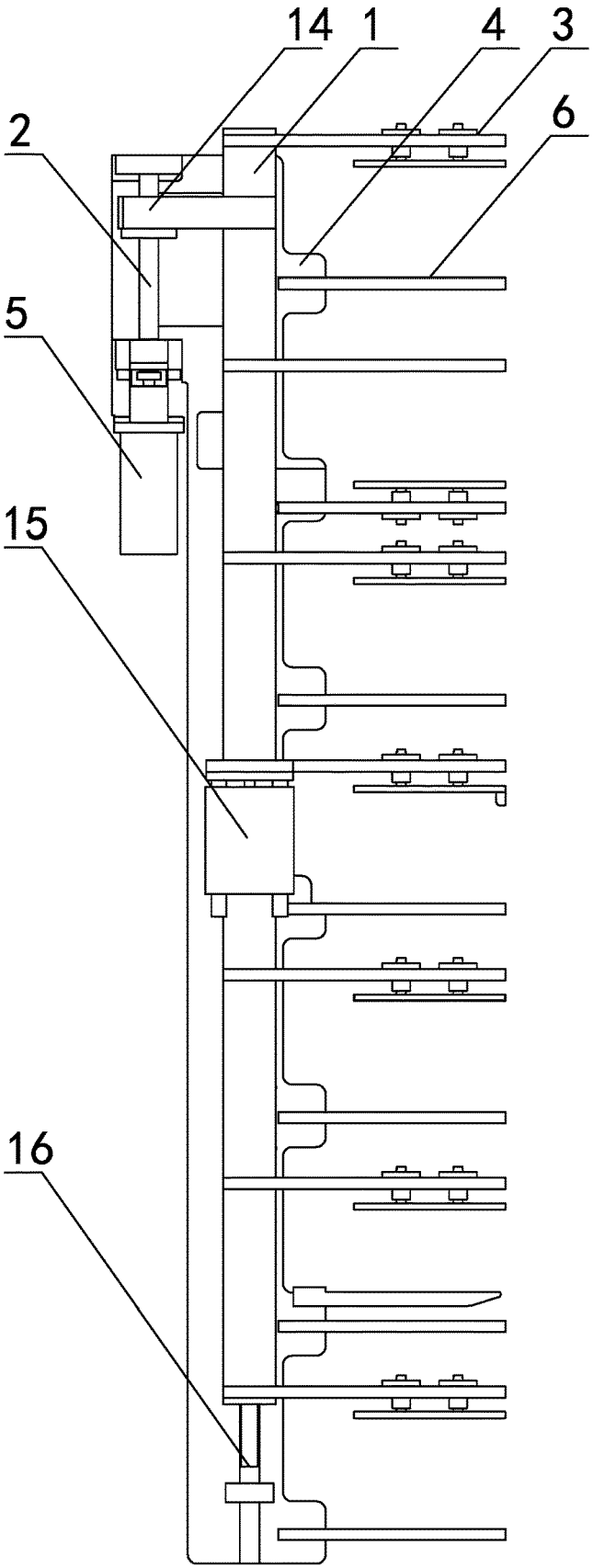
FIG. 3 is a front view of a clamping arm of a packaging box hoisting device.

Referring to FIG. 3, each clamping arm includes an inner clamping plate 1 and an outer clamping plate 4. The inner clamping plate 1 and the outer clamping plate 4 are arranged vertically. The outer clamping plate 4 is located outside the inner clamping plate 1. The driving device is configured to drive the inner clamping plate 1 and the outer clamping plate 4 to move relatively. A clamping slide rail 16 is arranged on an abutted surface of the inner clamping plate 1 and the outer clamping plate 4. The inner clamping plate 1 and the outer clamping plate 4 are slidably connected through the clamping slide rail 16. The lifting nut seat 11 is fixed to an inner side face of the inner clamping plate 1 in each clamping arm, and the lifting nut seat 11 may also be fixed to the outer clamping plate 4. Clamp plates fixed to ends of the inner clamping plate 1 and the outer clamping plate 4 form the operation station.

The clamp plates include upper clamp plates 3 and lower clamp plates 6. Multiple upper clamp plates 3 are arranged on an inner side face of each inner clamping plate 1 from top to bottom. Multiple lower clamp plates 6 are arranged on an inner side face of each outer clamping plate 4. The upper clamp plates 3 and the lower clamp plates 6 correspond to each other one by one vertically. The lower clamp plates 6 extend inward and are located directly below the corresponding upper clamp plates 3. Both the upper clamp plates 3 and the lower clamp plates 6 extend horizontally forward. A corresponding group of upper clamp plates 3 and lower clamp plates 6 form an operation station corresponding to the packaging box 33 one by one. A distance between the upper clamp plate 3 and the corresponding lower clamp plate 6 is the height of the operation station.

An auxiliary adjusting cylinder 15 may also be arranged on the inner side face of the inner clamping plate 1. When the auxiliary adjusting cylinder 15 is arranged, the upper clamp plate 3 corresponding to the station is fixed to a piston rod of the auxiliary adjusting cylinder 15. The height of the corresponding station may be independently adjusted by controlling an output distance of the piston rod of the auxiliary adjusting cylinder 15. The auxiliary adjusting cylinder 15 may also be fixed to the outer clamping plate 4, and the corresponding lower clamp plate 6 is fixed to the piston rod of the auxiliary adjusting cylinder 15. The auxiliary adjusting cylinder 15 may also be fixed to the inner clamping plate 1 and the outer clamping plate 4 at the same time. At this moment, the upper clamp plate 3 and the lower clamp plate 6 are fixed to the piston rod of the corresponding auxiliary adjusting cylinder 15. The auxiliary adjusting cylinder 15 may also be realized in other ways, such as a linear motor.

The driving device is a clamping motor 5. The clamping motor 5 is arranged above a rear end of the clamping arm. A motor shaft of the clamping motor 5 is vertically upward. A clamping screw 2 is coaxially fixed to the motor shaft of the clamping motor 5. The clamping screw 2 is reversely threaded to the inner clamping plate 1 and the outer clamping plate 4 respectively. Specifically, two nut seats are sleeved on the clamping screw 2 at intervals from top to bottom. The two nut seats are reversely threaded to the clamping screw 2 respectively. The upper nut seat is fixed to the inner side face of the inner clamping plate 1 through an internal fixing member 14, and the lower nut seat is fixed to the outer clamping plate 4. When the clamping motor 5 rotates, the inner clamping plate 1 and the outer clamping plate 4 may be driven to move relatively in reverse direction by the two nut seats reversely threaded, and the upper clamp plate 3 and the lower clamp plate 6 in each operation station are further driven to move close to and away from each other, thus realizing the clamping and releasing of the packaging box 33 in the operation station.

Figure 5:
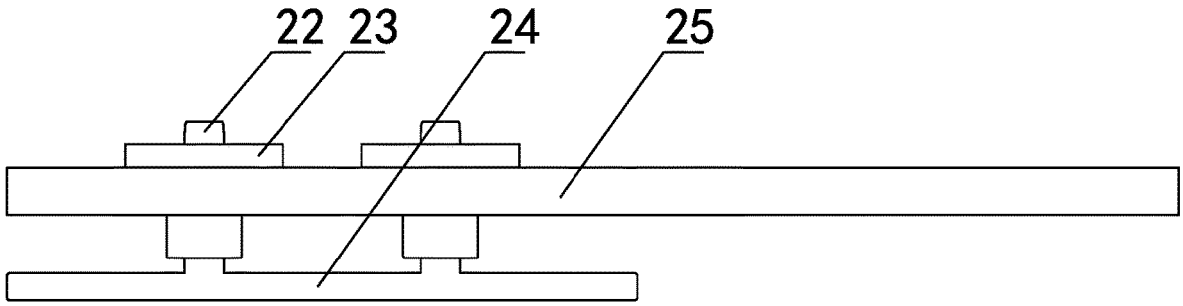
FIG. 5 is a schematic structural diagram of an elastic clamp plate of a packaging box hoisting device.

In order to avoid indentation of the packaging box 33 when clamping the packaging box 33, the upper clamp plate 3 or the lower clamp plate 6 is an elastic clamp plate in each operation station. As shown in FIG. 5, the elastic clamp plate includes a fixing plate 25 arranged horizontally. A rear end of the fixing plate 25 is fixed to the inner clamping plate 1 or the outer clamping plate 4. Two through linear bearings 23 are arranged side by side at a front end of the fixing plate 25. A guide shaft 22 is arranged in each linear bearing 23. A floating plate 24 is arranged on the front side below the fixing plate 25. The front and rear sides of the floating plate 24 are fixed to the bottoms of the two guide shafts 22. Two springs (not shown) are also arranged between the floating plate 24 and the fixing plate 25. The two springs are fitted to the two linear bearings 23, and upper and lower ends of the two springs are in contact with the floating plate 24 and the fixing plate 25. Therefore, when clamping the packaging box 33, the floating plate 24 is in elastic contact with an upper surface (or lower surface) of the packaging box 33 under the action of the springs to avoid damage to the packaging box 33 caused by a rigid contact.

A braking mechanism for keeping the packaging box 33 in the operation station stationary at least when the driving device drives to release the packaging box 33 in the operation station is also arranged at the side of the fixing arm. In the packaging box hoisting device, end faces of the packaging box 33 in contact with the upper clamp plate 3 and the lower clamp plate 6 are defined as upper and lower end faces of the packaging box 33, and both ends of a box cover of the packaging box 33 are defined as left and right end faces of the packaging box 33, so that the remaining two end faces of the packaging box 33 are front and rear end faces thereof. The braking mechanism is located on the front and rear sides of each packaging box 33. Referring to FIG. 7, the braking mechanism is located between two groups of clamp plates (upper clamp plate 3 and corresponding lower clamp plate 6) at both ends in each operation station. The braking mechanism includes a braking fixing plate 31, and further includes two auxiliary fixing plates 30 arranged oppositely. The two auxiliary fixing plates 30 are arranged vertically on one side of the braking fixing plate 31. The two auxiliary fixing plates 30 are arranged oppositely and are arranged on both sides of each operation station. One auxiliary fixing plate 30 is slidably connected to the braking fixing plate 31 through a slide rail arranged on the side of the braking fixing plate 31, and the other auxiliary fixing plate 30 is fixed. A braking device drives the two auxiliary fixing plates 30 to move relatively.

The braking device is a braking cylinder 32. The braking cylinder 32 is located on a right side of the auxiliary fixing plate 30 which is slidably connected to the braking fixing plate 31. The braking cylinder 32 drives the two auxiliary fixing plates 30 to move close to or away from each other. Multiple groups of auxiliary clamp plates are arranged on the surfaces of the two auxiliary fixing plates 30 in one-to-one correspondence from top to bottom. The auxiliary clamp plates on the surface of each auxiliary fixing plate 30 correspond to the operation stations one by one. Each group of auxiliary clamp plates is located on both sides of the operation station, and directly faces the corresponding operation station from both sides of each operation station. The braking device may also be realized in other ways, such as an electric cylinder and a linear motor.

The specific working process and working principle are as follows.

In the packaging box hoisting device, the operation stations formed by the clamping arms are recorded as station 1, station 2, . . . , and station N in turn from bottom to top. For station 1, the translation motor 19 located on the inner sides of the two outer frames 8 rotates (rotating forward) to drive the two clamping arms forward to the packaging box 33 (not shown), and the corresponding packaging box 33 arrives at station 1. Then the clamping motor 5 above the two clamping arms rotates synchronously (rotating forward) to drive the inner clamping plate 1 and the outer clamping plate 4 of the two clamping arms to move relatively, whereby the upper clamp plate 3 and the lower clamp plate 6 of the two clamping arms clamp the packaging box 33 in station 1 from both sides of the packaging box 33. After the packaging box 33 is clamped by the two clamping arms, the braking cylinder 32 is reset, and the auxiliary clamp plate is separated from the packaging box 33.

Then, the lifting motor 10 in the lifting mechanism on both sides of the clamping arm rotates (rotating forward) to drive the two clamping arms to rise respectively. At the same time, stations 1, . . . , and N rise synchronously, and the packaging box 33 in station 1 rises to the position of the original station 2, . . . , and the packaging box 33 in station N−1 rises to the position of the original station N. The packaging box 33 in the original station N is transferred after all operations are completed. When the packaging box 33 in each operation station is raised to a new operation station, the packaging box 33 in each operation station is correspondingly packaged in the new operation station. After the packaging box 33 is correspondingly packaged in the new operation station, the braking cylinder 32 is operated to move the two auxiliary fixing plates 30 close to each other, and the packaging box 33 is clamped from both sides by the auxiliary clamp plates on the surfaces thereof.

After the packaging box 33 in the operation station is clamped by the auxiliary clamp plates, the clamping motor 38 above the two clamping arms rotates reversely to release the corresponding packaging box 33. At this moment, the packaging box 33 remains stationary under the action of the braking mechanism. Then the translation motor 19 rotates reversely to drive a lifting assembly and the clamping arm to move backward. The packaging box 33 is separated from the corresponding operation station. Finally the lifting motor 43 rotates reversely to drive the two clamping arms down respectively. The above-mentioned steps are performed again cyclically. The packaging boxes 33 arranged vertically are operated at one operation station in turn, are correspondingly packaged, and are finally outputted. As can be seen from the above, in the packaging box hoisting device, all packaging boxes 33 can be synchronously transferred in a vertical direction so as to contribute to the completion of various processes for product packaging in the vertical direction.

The above is only a preferred embodiment of the present disclosure, and is not intended to limit the present disclosure in other forms. Any technician familiar with the art may make changes or modifications to equivalent embodiments of equivalent changes by using the technical contents disclosed above. However, any simple modification, equivalent change and modification made to the above embodiment according to the technical essence of the present disclosure without departing from the technical solution of the present disclosure still belongs to the protection scope of the technical solution of the present disclosure.

What is claimed is:

1. A packaging box hoisting device, comprising a fixing arm arranged vertically, wherein a lifting mechanism for driving the lifting of the fixing arm is arranged at a side of the fixing arm; multiple operation stations are arranged in the fixing arm from top to bottom or from bottom to top; and a driving device for driving at least one operation station of the operation stations to move and fixing or releasing a packaging box in the at least one operation station is arranged at an end of the at least one operation station;

the fixing arm comprises at least one clamping arm; the clamping arm comprises an inner clamping plate and an outer clamping plate; clamp plates fixed to ends of the inner clamping plate and the outer clamping plate from the at least one operation station; and the driving device is configured to drive the inner clamping plate and the outer clamping plate to move relatively; and two clamping arms are arranged; outer frames are arranged on outer sides of the two clamping arms; translation guide rails are arranged on inner side faces of the two outer frames; the two clamping arms are slidably connected to the corresponding outer frames through the translation guide rails on the outer sides thereof; and a translation mechanism is arranged on the inner side face of the outer frame.

2. The packaging box hoisting device according to claim 1, wherein the translation mechanism for driving the fixing arm to move horizontally and reciprocally is arranged on an outer side of the lifting mechanism, and the lifting mechanism is connected to the translation mechanism.

3. The packaging box hoisting device according to claim 2, wherein the lifting mechanism comprises a lifting fixing plate; the lifting fixing plate is connected to the translation mechanism; a lifting motor is fixed to a surface of the lifting fixing plate; a lifting screw is coaxially fixed to a motor shaft of the lifting motor; and the lifting motor is threaded to the fixing arm through the lifting screw.

4. The packaging box hoisting device according to claim 1, wherein the translation mechanism comprises a translation motor; the outer frame is provided with a translation screw; the translation screw is connected to a motor shaft of the translation motor through a translation conveyor belt; the translation screw is threaded to a translation nut seat; and the translation nut seat is fixed to the lifting mechanism.

5. The packaging box hoisting device according to claim 1, wherein the lifting mechanism is fixed to the clamping arm; the clamp plates comprise upper clamp plates and lower clamp plates; multiple upper clamp plates are arranged on an inner side face of each inner clamping plate from top to bottom; multiple lower clamp plates are arranged on an inner side face of each outer clamping plate; and the upper clamp plates and the lower clamp plates correspond to each other one by one vertically.

6. The packaging box hoisting device according to claim 5, wherein the upper clamp plate or the lower clamp plate is an elastic clamp plate in each operation station.

7. The packaging box hoisting device according to claim 5, wherein an auxiliary adjusting device is also arranged in the at least one operation station; the auxiliary adjusting device is fixed to the inner clamping plate, and the upper clamp plate in the at least one operation station is fixed to a movable end of the auxiliary adjusting device; or/and the auxiliary adjusting device is fixed to the outer clamping plate, and the lower clamp plate in the at least one operation station is fixed to the movable end of the auxiliary adjusting device.

8. The packaging box hoisting device according to claim 1, wherein the driving device is a clamping motor; a motor shaft of the clamping motor is coaxially fixed to a clamping screw; and the clamping screw is reversely threaded to the inner clamping plate and the outer clamping plate.

9. The packaging box hoisting device according to claim 1, wherein a braking mechanism for keeping the packaging box in the at least one operation station stationary at least when the driving device drives to release the packaging box in the at least one operation station is also arranged at the side of the fixing arm.

10. The packaging box hoisting device according to claim 9, wherein the braking mechanism comprises two auxiliary fixing plates which are arranged oppositely; a braking device drives the two auxiliary fixing plates to move relatively; multiple groups of auxiliary clamp plates are arranged on surfaces of the two auxiliary fixing plates; and each group of auxiliary clamp plates is correspondingly located at both sides of the at least one operation station.

11. The packaging box hoisting device according to claim 1, wherein the two outer frames are connected by a width adjusting mechanism.

* * * * *